United States Patent [19]

Edwards et al.

[11] Patent Number: 4,520,924

[45] Date of Patent: Jun. 4, 1985

[54] MULTI-PACKAGE AND PACKAGING DEVICE

[75] Inventors: Bryant Edwards, Clarendon Hills; M. Julius Klygis, Barrington; Robert C. Olsen, Streamwood, all of Ill.

[73] Assignee: Illinois Tool Works Inc., Chicago, Ill.

[21] Appl. No.: 604,754

[22] Filed: Apr. 27, 1984

[51] Int. Cl.[3] ..... B65D 85/62; B65D 75/56

[52] U.S. Cl. ..... 206/150; 206/428

[58] Field of Search ..... 206/150, 428, 162

[56] References Cited

U.S. PATENT DOCUMENTS

| | | | |
|---|---|---|---|
| 3,608,949 | 9/1971 | Owen | 206/150 |
| 3,938,656 | 2/1976 | Owen | 206/150 |
| 4,269,308 | 5/1981 | Platt | 206/150 |
| 4,269,314 | 5/1981 | Barrash | 206/150 |
| 4,385,690 | 5/1983 | Olsen | 206/180 |
| 4,460,084 | 7/1984 | Miller | 206/150 |

*Primary Examiner*—Joseph Man-Fu Moy

*Attorney, Agent, or Firm*—Thomas W. Buckman

[57] ABSTRACT

A plastic band is provided for encircling and combining into a single package, two multi-package assemblies of cans. The plastic band of the present invention encircles the outside of the array of cans comprising the combination of two multi-packages and further provides a central stabilizing strap which provides firm resilient engagement with at least all of the corner cans of each individual multi-package.

9 Claims, 3 Drawing Figures

MULTI-PACKAGE AND PACKAGING DEVICE

BACKGROUND OF THE INVENTION

Various types of carriers and carrier devices have been suggested in the prior art and have been used commerically for assemblying a predetermined number of containers, usually six, for ease of carrying.

Recently larger arrays of containers have been packaged into, for example, 12-pack arrays using either a single top gripping carrier device which obviously holds all of the 12 cans in a fixed array or a pair of six-packs with two unconnected carrier devices. Typical prior art devices that have been successful in this area are those shown in U.S. Pat. Nos. 4,269,308, 4,385,691 and 4,385,690.

While the devices of the type shown or suggested above have been suitable for most applications, in certain situations, for example, when a can has an extremely polished or slippery finish, it is necessary to more firmly grip each individual six-pack array within the larger, 12-pack array to prevent relative movement of the individual six-packs within the larger array device.

It is therefore an object of the present invention to provide an encircling band carrier for a plurality of sub-package units which firmly retains the sub-package units relative to each other and to the encircling carrier band.

More clearly an object of this invention is to provide a multi-package device which incorporates an endless band and an intermediate band member having juncture regions which are designed to provide resilient engagement with substantially the entire periphery of individual package units contained within the outer band and more particularly with the corner containers in each individual package unit.

In achieving the foregoing objects in accordance with the present invention a plastic packaging device is provided which completely encircles a plurality of groups or arrays of cylindrical containers, such as, a double six-pack of cans or a double four-pack of bottles. A subsidiary dividing band is provided which lies between the sub-packages or individual arrays. The subsidiary dividing band includes a juncture at its interconnection with the outer band which is generally Y-shaped so that the corner cans in the innermost regions of each individual array is resiliently and firmly engaged to reduce relative movement between the sub-units or individual arrays and the bands and between each sub-unit.

DETAILED DESCRIPTION OF THE PREFERRED EMBODIMENT

Figure 1:
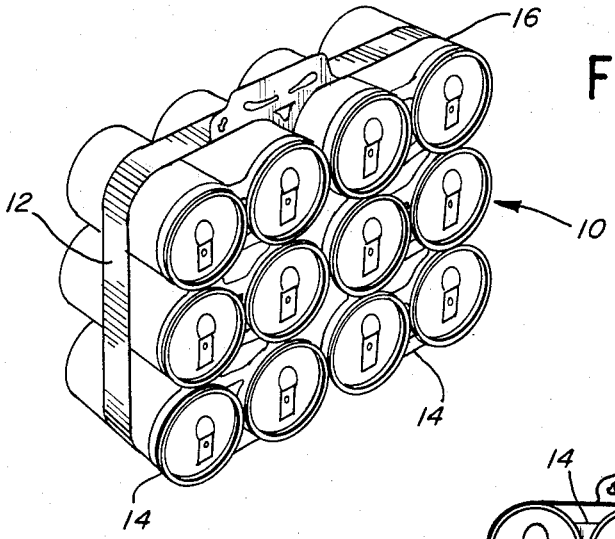
FIG. 1 is a perspective view of the multi-package utilizing the invention.
Figure 2:
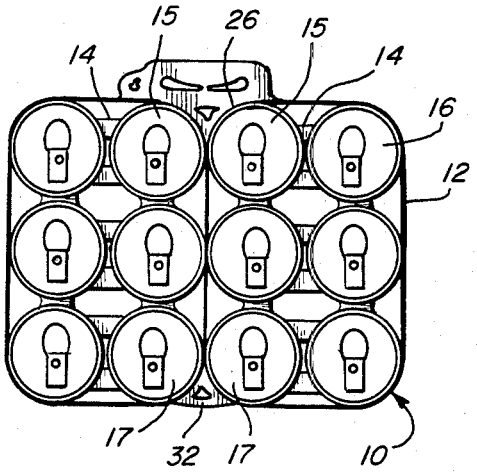
FIG. 2 is a top plan view of the multi-package untilizing the invention.

Referring now in greater particularity to the drawings and first to FIGS. 1 and 2, it will be shown that a multi-package 10 of the invention includes a first packaging device 12 and a plurality of second packaging devices 14 cooperating together to unitize a plurality of containers 16.

Typically containers which are to be effectively packaged using this invention are can-type containers having a cylindrical sidewall, a top lid and an annular chime which forms a perimeter on the top lid. Second packaging devices 14 are generally of the type shown in U.S. Pat. Nos. 2,874,835, 3,874,502 and 4,219,117. Each of the top or second carrier devices 14 are designed to resiliently engage beneath the chimes of the cans to unitize a predetermined plurality or array of such containers into what will hereinafter be described as sub-packages.

The first packaging device 12 is preferably defined as including an endless band 18 configured in a generally oval shape having a handle 20 formed in the outer periphery of the band and an intermediate strap means 22, which is preferably located midway of the longitudinal extremeties of the band and interconnecting the width of the band.

As in the prior art devices in U.S. Pat. Nos. 4,385,690 and 4,385,691 the intermediate band is designed to be of a length, in its package creating modes which is greater than the width of the package making device 12 in a blank form to accommodate the need to stretch the first carrier device laterally to be telescopically associated with the plurality of sub-packages.

In typical assembly operations, the device 12 is formed so an endless plurality of such devices are interconnected by regions 19 in an end-to-end fashion and wound about a reel for relatively high speed assembly about arrays of six-packs. Stretching jaws are arranged to contact the inner periphery 40 of the device 12 at predetermined areas and laterally spread and stretch the band, reshaping it into a packaging device which is of a greater width and less length than the blank shown in FIG. 3. A preferred package arrangement would be for each six pack to be arrayed with the rows extending transversely of the package 10 to ultimately create an array of cans that are 3 containers by 4 containers as in U.S. Pat. Nos. 4,385,690 and 4,385,691.

Figure 3:
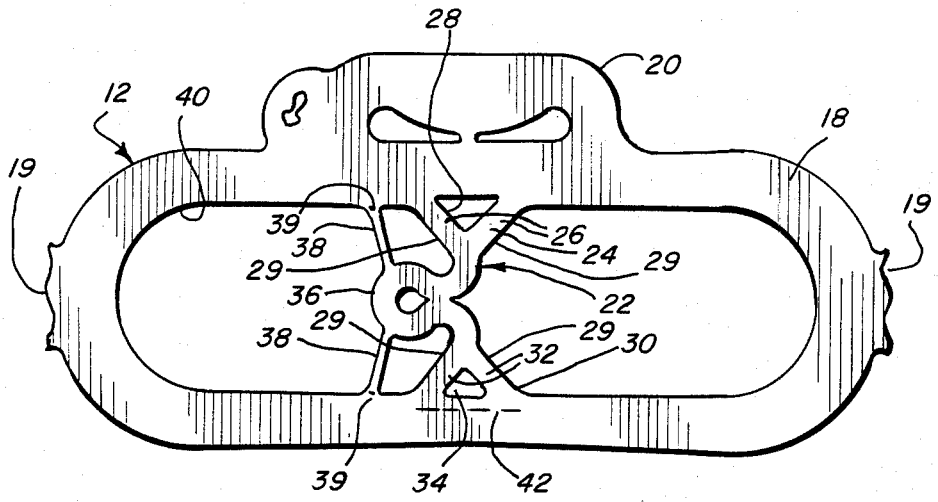
FIG. 3 is a top plan view of a preferred embodiment of the blank which is to be utilized to create the multi-package of the present invention.

Turning now with more particularity to FIG. 3. The intermediate strap means 22 will have a central region 36 and a pair of opposed juncture regions 24 and 30. Each juncture region is formed to be generally Y-shaped with a pair of diverging legs 26, 32 respectively joined in a longitudinally spaced fashion at a base region on the inner edge region of band 18. Thus, in a preferred embodiment juncture 24 creates a generally triangular shaped aperture 28 and opposing juncture 30 creates a similarly configured but slightly smaller triangular shaped aperture 34.

In use, as stretching jaws deform the carrier device laterally as described above, strap 22 is transformed from loop 36 to a taut strap by frangible means 37. As the band is telescopicly associated with individual arrays of containers, the legs 26 and 32 of junctures 24 and 30 resiliently engage corner cans 15 and 17 of each sub-package unit or 6-pack array. This engagement creates and enhances a substantial, wrap-around frictionally engagement between each of the sub-package units and the device 12. It should be noted that this resilient corner surface engagement occurs at the juncture of intermediate band and the outer band 18 and creates relatively independent gripping of each adjacent sub-package unit. Thus, it provides the stability and unitization necessary to create a firm and well gripped package even when the cans to be packaged are relatively slippery.

It has been further found that the use of a straight inner edge 29 on the legs 26 and 32 is important to maximize this resilient engagement while the triangular shaped apertures 28 and 34 permit the independent gripping that further enhances the package.

Since the endless band is designed to be relatively taut and slightly stretched in an assembled position, it has been found that significant stretching forces are typically applied at the curved end regions of the blank. To balance the stretching and to prevent overstretching failure, it should be noted that band 18 is slightly narrowed adjacent the juncture region 30, which is opposite the region of handle 20. This permits the band region at that area to be stretched taking some of the stretching forces away from the highly concentrated stretch areas of the radiused ends of the device.

In certain instances it is essential that the band lie flat against the sidewall of the cans. For example, if a label is to be applied adjacent the handle any bend lines that would occur as a result of the juncture should be eliminated. For this reason, the base region of the aperture 28 is preferably located within the inner boundary of the band 18 to clearly eliminate any fold lines at that region. It is also possible that the folding tendencies of the band against the sidewalls may detract from the complete independent operation of the yoke regions. For this later purpose it should be noted that a score or bend line 42 is created lengthwise of the band in the area intermediate the securement of the legs 32. Thus, the band itself can firmly engage the cans as shown clearly in FIG. 1 while the function of the Y-shaped juncture is not compromised.

The loop region 36 may tend to move freely in and out of the plane of the carrier blank during high speed reeling or feeding processes which may have a harmful effect on such an automatic assembly. For this reason securement arms 38 are created which may remain in the finished package by virtue of the frangible connection 39.

The single example of the invention as herein shown is for illustrative purposes only. Various changes in structure may occur to those skilled in the art and it will be understood as forming part of present invention as far as it falls within the spirit and scope of the appended claims.

We claim:

1. A multi-packaging device comprising a first integral resilient plastic strip formed as a continuous loop, an intermediate strip extending across said loop having opposite ends integral with said first strip, a juncture region at each end of the intermediate strip including a pair of diverging strap segments each extending generally diagonally between the intermediate strip and the first integral resilient strip wherein a plurality of arrays of containers may be positioned within said first strip with the intermediate strip positioned therebetween so that the strap segments resiliently engage the corner regions of an associated array.

2. The multi-packaging device of claim 1 wherein said loop lies substantially in a common plane and said intermediate strip lying in the same common plane with the middle region of the intermediate strip being displaced from a straight line between said opposite ends to only one side of said straight line.

3. The multi-packaging device of claim 1 wherein the strap segments of each pair of diverging strap segments are separated from each other by an aperture, creating independent functioning container gripping segments.

4. The multi-package of claim 3 wherein the strap segments are separated by a triangular aperture, with the base of the triangular aperture adjacent the inner edge of the continuous loop and the apex of the triangle spaced inwardly from the inner edge.

5. The multi-package device of claim 3 wherein the innermost edges of the strap segments which are designed to initially contact the containers are linear.

6. The multi-package device of claim 1 wherein a handle is integral with the endless band generally in line with the juncture regions of the intermediate strip, the region of the loop adjacent the juncture opposite the handles being narrowed relative to the remainder of the band.

7. The multi-package device of claim 1 wherein the loop is oval in configuration with a pair of opposing parallel sides interconnecting a pair of end radiused sections.

8. The multi-package of claim 4 which includes a handle integral with the endless band generally in line with the juncture regions of the intermediate strip, the triangular aperture adjacent the handle being larger in perimeter than the triangular aperture in the opposing juncture, the base of the smaller triangular aperture being co-linear with the adjacent inner edge of the endless band, a score line spaced outwardly and transversely aligned with the base of the smaller triangular aperture to facilitate bending of the band in the finished package.

9. A package unit comprising a plurality of cylindrical containers arranged in a first array of rows and columns, an integral first resilient strip means formed as a continuous loop circumscribing said first array, a plurality of second arrays incorporated within said first array, a plurality of carrier devices securing each of the second arrays together adjacent the uppermost extremities of the containers, intermediate strap means integrally interconnecting opposed portions of the inner margin of said endless band and positioned between the plurality of second arrays, the resilient strip means positioned intermediate the carrier devices and the lower extremities of the containers, the juncture region of the extremities of the intermediate strap means and the inner margin of the endless band each including a pair of strap segments frictionally and resiliently engaging a peripheral portion of each associated corner container in each second array to unitize each second arrays independently with the resilient strip means.

* * * * *